US007841797B2

(12) United States Patent
Delage

(10) Patent No.: US 7,841,797 B2
(45) Date of Patent: Nov. 30, 2010

(54) DEVICE FOR PACKAGING AND APPLYING A PRODUCT

(75) Inventor: Jean-Francois Delage, Clamart (FR)

(73) Assignee: L'Oreal, Paris (FR)

( * ) Notice: Subject to any disclaimer, the term of this patent is extended or adjusted under 35 U.S.C. 154(b) by 1010 days.

(21) Appl. No.: 11/312,339

(22) Filed: Dec. 21, 2005

(65) Prior Publication Data

US 2007/0014625 A1 Jan. 18, 2007

Related U.S. Application Data

(60) Provisional application No. 60/640,220, filed on Jan. 3, 2005.

(30) Foreign Application Priority Data

Dec. 21, 2004 (FR) ..... 04 53109

(51) Int. Cl.
*B43K 7/10* (2006.01)

(52) U.S. Cl. ..... 401/216; 401/6; 401/207; 401/209

(58) Field of Classification Search ..... 401/6, 401/48, 191, 207, 209, 214, 216
See application file for complete search history.

(56) References Cited

U.S. PATENT DOCUMENTS 2,488,179 A * 11/1949 Engel, Jr. ..... 401/54
5,213,431 A 5/1993 Gentile et al.
5,842,806 A * 12/1998 Rettke ..... 401/213
6,132,126 A 10/2000 Sheffler et al.
6,530,707 B1 * 3/2003 Byrne et al. ..... 401/6
2004/0131414 A1 7/2004 Delage

FOREIGN PATENT DOCUMENTS

EP 0 506 564 9/1992
EP 0 712 592 5/1996

* cited by examiner

*Primary Examiner*—David J Walczak
(74) *Attorney, Agent, or Firm*—Oblon, Spivak, McClelland, Maier & Neustadt, L.L.P.

(57) ABSTRACT

A device for packaging and applying a product including a container holding the product. In an example, the container has a lengthwise axis X and is provided with an applicator element designed to come into contact with a surface to be treated in order to apply the product. The applicator element is in fluid communication with the container when it is in contact with this surface to be treated. A support defines a seating for the applicator element, with the support being at least in a fixed axial position relative to the container. The device further includes a grasping element connected to the support by a resiliently deformable connecting element in a manner such that, in response to a force exerted on the applicator element when the device is being held by the grasping element, the support is able to move relative to the grasping element. In addition, the support is preferably designed to revert to its initial position when the exertion of force ceases.

46 Claims, 2 Drawing Sheets

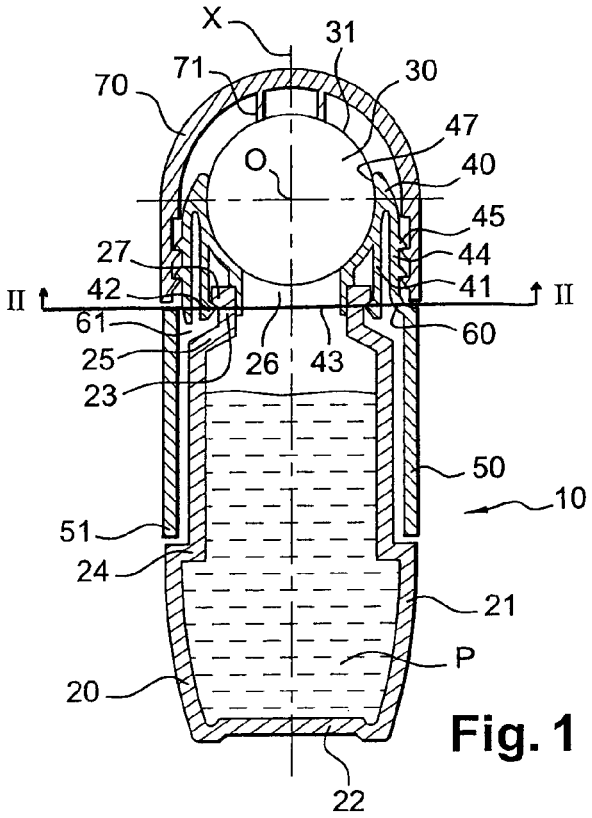
Fig. 1
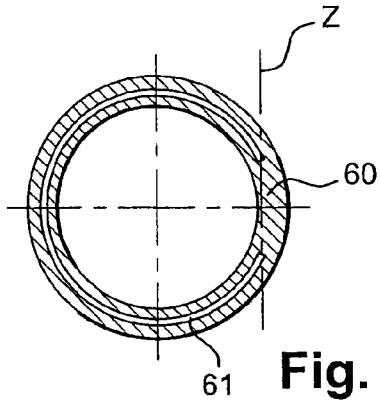
Fig. 2
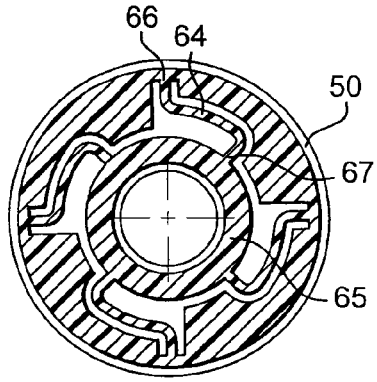
Fig. 9
Fig. 3
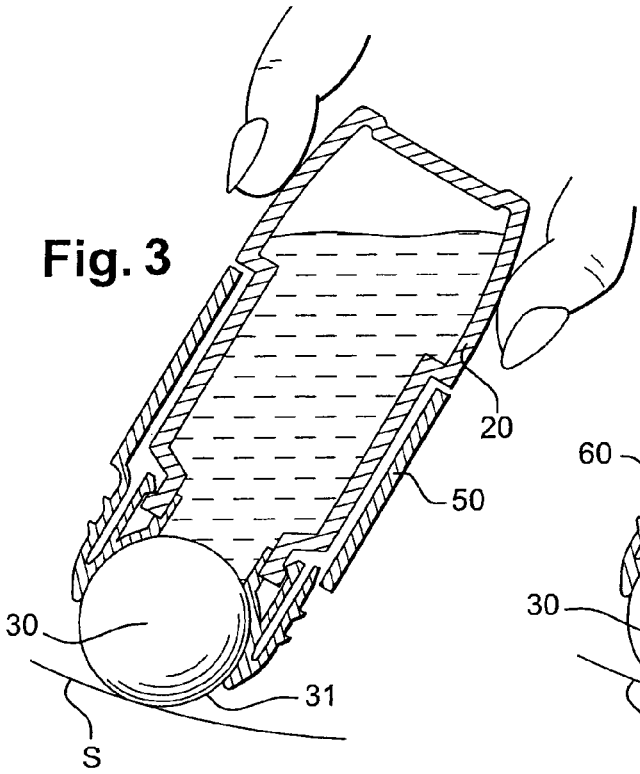
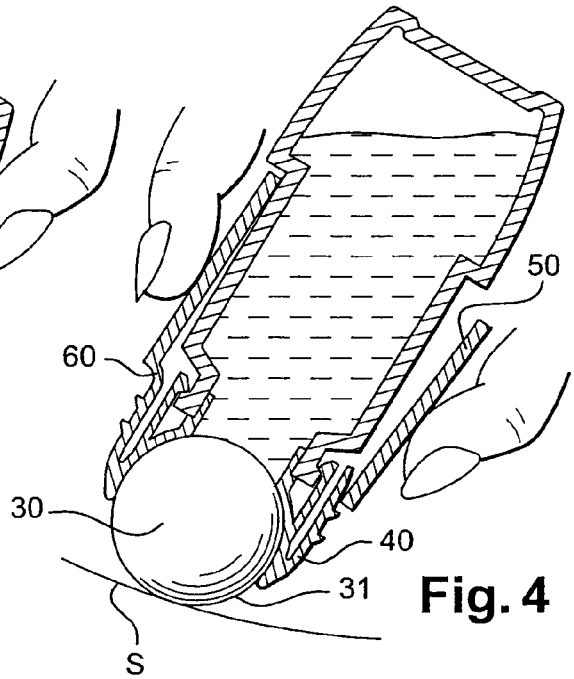
Fig. 4

DEVICE FOR PACKAGING AND APPLYING A PRODUCT

CROSS-REFERENCE TO RELATED APPLICATIONS

This document claims priority to French Application Number 04 53109, filed Dec. 21, 2004 and U.S. Provisional Application No. 60/640,220, filed Jan. 3, 2005, the entire contents of which are hereby incorporated by reference.

FIELD OF THE INVENTION

The present invention relates to packaging and applicator devices. The invention can be particularly advantageous for cosmetic products, such as a make-up or skin care products, and more particularly where the product is fluid, preferably a liquid.

BACKGROUND OF THE INVENTION

Discussion of Background

For the purposes of the invention, the expression "cosmetic product" is understood to mean a product as defined in Directive 93/35/CEE dated 14 Jun. 1993 amending Directive 76/768/CEE.

Patent application EP 0 506 564 describes a known device for packaging and applying a cosmetic product including a container to which is attached a head housing a ball. The head carrying the ball is mounted on the container via a spring which enables it to slide within the container. When the ball is applied against the skin, the head slides allowing a valve to open thereby enabling the product held in the container to pass towards the ball. When the application ceases, the head housing the ball is returned by the spring to its initial position in which the valve is closed.

U.S. Pat. No. 6,132,126 describes a packaging and applicator device including a container and a ball. The device is configured so that the product can be readily applied to different parts of the body, including parts that are difficult to reach. To this end, the container includes a bellows arrangement which enables the portion of the container carrying the ball to be tilted in different directions relative to the rest of the container. Once the device has assumed the chosen tilt position adapted to the area in which the product is to be applied, the user can apply the ball.

SUMMARY OF THE INVENTION

There is a need to improve packaging and applicator devices, including those which have a ball applicator. Preferably such a device should provide the user with a greater feeling of comfort during application.

There is also a need to enable the user to employ a number of different hand postures in order to apply the product using the same packaging and applicator device.

The invention meets these needs by providing a device for packaging and applying a product which includes a container, holding the product, and having a lengthwise axis X. An applicator element is designed to come into contact with a surface to be treated in order to apply the product, with the applicator element being in fluid communication with the container when it is in contact with the surface to be treated. A support defines a seating for the applicator element, with the support being at least in a fixed axial position relative to the container.

The device additionally includes a grasping element connected to the support by a resiliently deformable connecting element in a manner such that, in response to a force exerted on the applicator element when the device is being held by the grasping element the support is able to move relative to the grasping element. In addition, the support is preferably designed to revert to its initial position when the exertion of force ceases.

During application, the invention gives the user a feeling of comfort by virtue of the fact that the pressure exerted by the applicator device on the skin is transmitted to the applicator element by the resiliently deformable connecting element, when the user is holding the device by the grasping element.

In addition, during application the applicator element can more easily follow the contours of the body, including the face, by virtue of the mobility of the support relative to the grasping element.

The container can include a graspable outer surface which thus constitutes a second grasping zone of the device to apply the product. The user therefore has the choice of applying the product by holding the device by the container or by the grasping element. In the former case, the user can apply the product in a conventional manner, and in the latter case a gentler application can be obtained. The device according to the invention thus offers the user two hand postures with which to apply the product.

By way of example, the support can be designed to tilt about an axis of rotation Z relative to the grasping element. Also by way of example, the connecting element can include a wall which extends over less than half the circumference of the support so as to define the axis of rotation Z.

The support can also be designed to move parallel to a lengthwise axis X of the device.

For example, the connecting element can include a helical spring. The spring can be made, for example, in one piece by plastic molding with the grasping element and/or with the support. The spring can also be metallic. The connecting element can include, for example, a pair of resiliently deformable material bridges.

In another example, the connecting element can include a wall made of a resiliently deformable material. The resiliently deformable material can be selected from very low density polyethylene, elastomers of propylene/ethylene copolymers, polyester block amides, polyvinyls, ethylene propylene diene terpolymers (EPDM), sequenced styrene-butadiene polymers (SBS), sequenced styrene-ethylene-butadiene polymers (SEBS-SIS), thermoplastic polyurethanes, mixtures of polypropylene with one of the elastomers selected from sequenced styrene-ethylene-butadiene polymers (SEBS-SIS), ethylene propylene diene terpolymers (EPDM), sequenced styrene-butadiene polymers (SBS).

According to one example, the grasping element can surround a portion of the container, with the other portion of the container being graspable.

The grasping element can be disposed at a sufficient distance from the container to allow relative movement of the grasping element in relation to the container. For example, the grasping element can be sufficiently distanced laterally from the outer surface of the container to allow sufficient angular play to allow a tilting movement about the axis Z.

The support can define a seating designed to be traversed by the product emerging from the container.

The applicator element can be non-rotatable in the seating, or can be rotatably movable in the seating. The applicator element can in particular be rotatably movable about a point in the seating, or about a geometric axis, for example, an axis perpendicular to a lengthwise axis of the device.

The applicator element can have a substantially spherical shape. As a variant, the applicator element can have, for example, a cylindrical, ovoid, discoid or annular shape.

Also by way of example, the shape of the support can be a portion of a sphere which conforms to the shape of the applicator element.

The applicator element can be substantially non-deformable during use.

The applicator element can be made, for example, of a porous material so as to enable the product to flow through the applicator element.

The invention also provides a method of applying a product onto a surface to be treated including the steps of providing a device for packaging and applying a product as described above, and applying the applicator element onto the surface to be treated, holding either the container, or the grasping element in order to obtain a gentler application. The method can additionally include the step of causing the applicator element to rotate relative to the support in order to apply the product.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will become further apparent from the following detailed description, particularly when considered in conjunction with the drawings in which:

FIG. 1 shows a diagrammatic and partial representation, in axial cross section, of an example of a packaging and applicator device according to the invention, FIG. 2 shows a cross-section of the device in FIG. 1 in the plane II-II, FIG. 3 is a diagrammatic view of the device in FIG. 1, during the application of product to the skin using a first hand posture or holding position, FIG. 4 is a diagrammatic view of the device in FIG. 1, during the application of product to the skin using a second hand posture or holding position, FIGS. 5 to 9 are diagrammatic illustrations of alternative embodiments of packaging and applicator devices according to the invention.

DETAILED DESCRIPTION OF THE PREFERRED EMBODIMENTS

Figure 5:
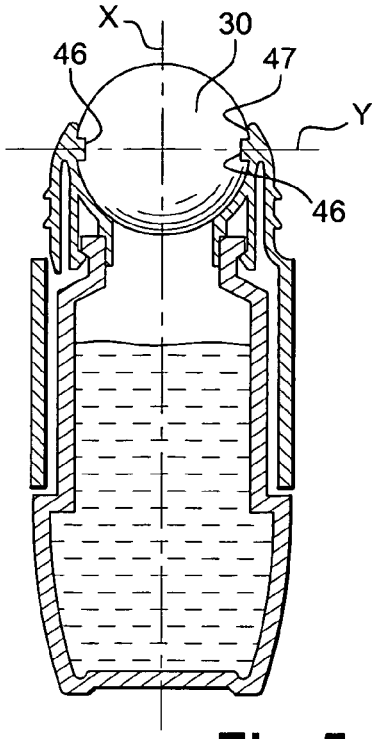

FIGS. 1 to 4 depict an example of a packaging and applicator device 10 for a cosmetic product P, for example a make-up, skin care product or deodorant, including a container 20 holding the product P, and an applicator element 30 enabling the product to be dispensed.

The container 20 has a lengthwise axis X and includes a sidewall 21 connecting a bottom 22 to a neck 23 extending on the axis X. The sidewall 21 includes a first shoulder 24 at approximately mid-height on the wall and a second shoulder 25 at its upper end which connects it to the neck. The upper end of the neck 23 delineates an opening 26 which allows the product to pass through.

The applicator element 30 is accommodated in a seating 47 defined by a support 40 which is attached in the example described by snapping onto the neck 23 of the container 20. To this end, the support 40 includes a fixing skirt 41 incorporating a projection 42 on its inner surface which engages with a projection 27 provided on the outer surface of the neck 23. The support is in a fixed axial position relative to the container. It can additionally be immobile in rotation relative to the container.

The support also includes a sealing lip 43 designed to bear in a leaktight manner on the inner surface of the neck 23.

An outer covering skirt 44 surrounds the fixing skirt 41 and includes a screw thread 45 on its outer surface for a screw-on cap 70 provided to close the container surmounted by the applicator element in a leaktight manner relative to the product.

The seating 47 is traversed by the product emerging from the container, and the product is able to circulate in a space formed between the applicator element 30 and the support 40. The applicator element can come into contact with the support at certain points.

In the example illustrated, the applicator element 30 has a substantially spherical shape so as to form a ball.

The seating 47 is also generally spherical in shape, forming a segment of a sphere. The seating 47 is open at its lower end to facilitate communication with the inside of the container. In addition, the seating 47 allows an upper portion 31 of the ball 30 to project therefrom to facilitate application. The ball 30 can be set in the support by resilient deformation of the latter, for example.

The ball 30 is held with the ability to rotate in the support 40 about its center O, its rotation tending to assist the product P to pass more easily through the seating. However, it is to be understood that the invention can also be used with an applicator element that is non-rotatable, for example with an applicator that is fixed in the seating.

As a further variant, provision can be made for the applicator element 30 to be mounted on two tabs 46 which define an axis of rotation Y, as illustrated for example in FIG. 5. The applicator element is thus rotatably movable about the axis Y, perpendicular to the axis X of the neck.

The ball 30 is substantially non-deformable during application. It can for example be made of an agglomerate material, in particular a thermoplastic agglomerate material. By way of example, the largest dimension (for example, the diameter when the element is spherical) of the applicator element can be between 5 mm and 65 mm, preferably between 7 mm and 50 mm.

The ball 30 can optionally be covered in a flock material and can be made in a variety of materials, for example, it can be charged with particles designed to exert an effect on the product or on the surface treated with the product. This effect can be a magnetic field or the release of a substance, for example ions.

A grasping element 50 in the form of a cylindrical skirt surrounds the upper part of the container. In the example illustrated, the skirt preferably extends over a relatively long length in a manner such that it can be readily grasped in one hand. In the example shown, the lower end 51 of the skirt is situated just above the shoulder provided on the wall of the container. As can be seen in FIG. 1, the end 51 is a free end. As shown, the free end is not connected to a resiliently deformable element (in contrast to the upper or other portions of the grasping element 50 as discussed hereinafter), but instead the end 51 is free. The skirt 50 can surround the container over its entire circumference or as a variant over only a part of its circumference thereby leaving a larger portion of the outer surface of the container graspable.

The shape of the sidewall 21 of the container, and in particular the presence of the shoulder 24, allows the skirt 50 to extend in axial alignment with the wall 21 of the container situated below the shoulder 24.

In the example illustrated in FIGS. 1-4, the skirt 50 is connected, at its upper part, to the bottom edge of the covering skirt 44 by a transverse wall 60. In this example, the transverse wall extends over an angular portion only of the periphery or circumference of the covering skirt 44. In particular it extends over a portion less than half the circumference of the covering skirt thereby better allowing a tilting movement about an axis Z defined by its two ends, as can be seen in FIG. 2. An annular space 61 extends transversely beyond the wall 60. As can be seen in FIG. 2, the skirt 50 can extend about the entire periphery of the container, but only be connected to the skirt over a portion of the periphery.

In the example considered, the distance between the inner surface of the grasping element 50 and the outer surface of the container 20 surrounded thereby is non-null, and is sufficient to allow a degree of movement of the container 20 relative to the grasping element 50 about the geometric axis of rotation Z defined by the transverse wall 60.

In this example, the grasping element is obtained by one-piece molding with the support.

In the closed position of the device illustrated in FIG. 1, the cap is in place on the container, closing the latter in a leaktight manner. A support skirt 71 is provided on the inner surface of the cap to bear on the ball, which tends to press the ball against the concave wall of the support, the contact between the two tending to prevent the product P from flowing out of the container.

The device can be used in the following manner. The user turns the container upside down to allow the product P to flow into the seating housing the ball which then becomes loaded with the product P.

Depending on the type of application desired, the user can choose to hold the device by the graspable portion of the container 20, as illustrated in FIG. 3, for a conventional application. As the support 40 is fixed on the container, it is immobile when the ball is applied against the skin when holding the device by the container. During application, the user causes the ball to roll over the skin S thereby depositing the product onto the skin.

If the user desires a gentler application, he/she holds the device by the grasping element 50. During application, the user can cause the ball to roll over the skin S, with the wall 60 being capable of deforming in relation or in response to the contours of the surface to which the product is being applied, as illustrated in FIG. 4. The support 40 housing the ball can in effect tilt about the axis Z. The ability of the ball 30 to move relative to the grasping element 50 improves the level of comfort experienced during application.

In accordance with the invention alternate connecting or coupling arrangements can be utilized using a connecting element other than the wall 60.

Figure 8:
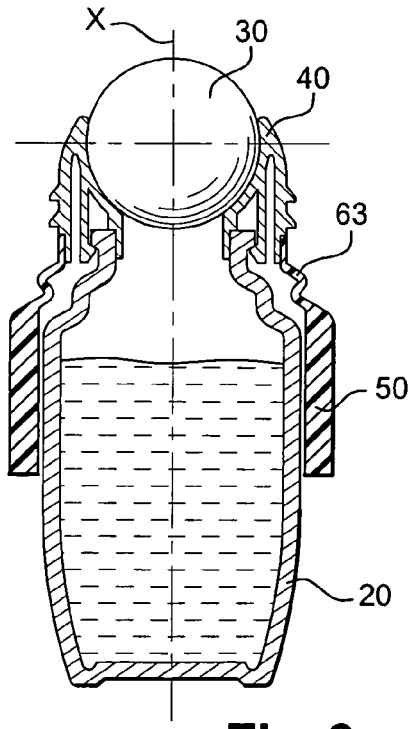

By way of further example, as illustrated in FIG. 8, the support 40 housing the ball can be connected to the grasping element 50 via an annular wall 63 made of a resiliently deformable material. For example, the resiliently deformable material can be selected from very low density polyethylene, elastomers of propylene/ethylene copolymers, polyester block amides, polyvinyls, ethylene propylene diene terpolymers (EPDM), sequenced styrene-butadiene polymers (SBS), sequenced styrene-ethylene-butadiene polymers (SEBS-SIS), thermoplastic polyurethanes, mixtures of polypropylene with one of the elastomers selected from sequenced styrene-ethylene-butadiene polymers (SEBS-SIS), ethylene propylene diene terpolymers (EPDM), sequenced styrene-butadiene polymers (SBS).

In this example embodiment, the skirt forming the grasping element 50 can be made of the same material as the connecting element. The skirt 50 then preferably has a thickness greater than that of the connecting element, which enables it not to deform substantially when it is held.

As illustrated in FIG. 9, which is a top view of the connecting element provided between the grasping element 50 and the support 40, and as a variant to FIG. 8, the connecting element in this instance takes the form of one or more material bridges 64, and preferably at least one pair of material bridges such as 64. To this end, the support 40 includes an annular band 65 to which are connected the material bridges 64 extending from the grasping element 50. By way of example, the annular band 65 can be combined with the covering skirt 44. For example, an even number, in particular between 2 and 6, of material bridges 64 can be provided to make this connection. In particular, these material bridges 64 are preferably evenly spaced on the inner circumference of the grasping element 50.

Preferably, the material bridge(s) 64 is (are) arranged to provide a degree of axial play between the support 40 and the grasping element 50. For example, the bridge(s) can be made of a material selected from polyolefins, in particular polyethylene or polypropylene. The material bridges 64 are arranged to provide an axial play of less than 10 mm, and preferably between 2 and 6 mm. In particular, these material bridges 64 are resiliently deformable and can be obtained by means of thin tabs extending, partly circumferentially around the annular band 65, so that a point of attachment 66 of the tab on the grasping element 50 is not radially aligned with its point of attachment 67 to the annular band 65. For example, the tab can extend on an angular arc of between 15° and 60°, and for example 30°, around the grasping element 50. The width of a tab 64 between its respective points of attachment 66 and 67 is between 1 mm and 10 mm, for example, and preferably between 2 and 6 mm. Preferably, the grasping element 50, the material bridges 64 and the annular band 65, and possibly the support 40, are made in one-piece from the same material.

Figure 7:
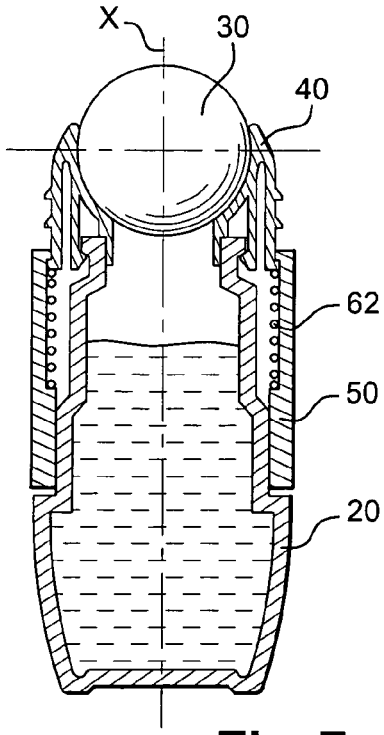

As a further variant, by way of example, the support 40 housing the ball 30 can be connected to the grasping element 50 via a helical spring 62 of axis X. This spring can take the form of a fitted part as shown in FIG. 7, or can be made by plastic molding.

In these three examples, the support 40 housing the ball can move parallel to the axis X of the device when the user applies the ball against the skin and holds the device by the grasping element 50.

Instead of a ball, the applicator element can be of any other shape, for example, cylindrical, ovoid, discoid or annular.

Figure 6:
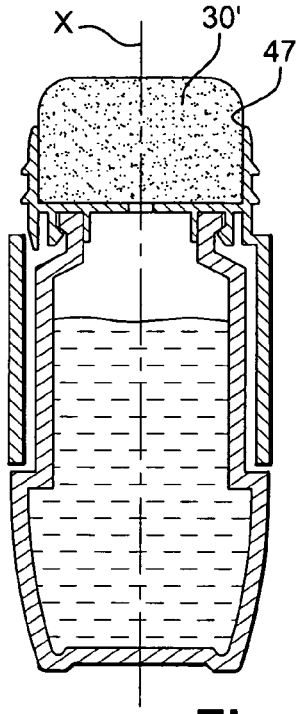

FIG. 6 illustrates a device which includes a cylindrical applicator element 30'. The applicator element 30' is not rotatable in the seating 47, and in particular it is fixed to the inside of seating. In the example illustrated, the applicator element 30' is porous. The applicator element is for example made of an agglomerate material. The product then passes through the applicator element to arrive at its outer surface instead of passing around it, as in the example described previously.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for packaging and applying a product including:

a container holding the product, the container including a lengthwise axis X;

an applicator element designed to come into contact with a surface to apply the product to the surface, wherein the applicator element can be placed in fluid communication with the container when it is in contact with the surface to be treated;

a support defining a seating for the applicator element, the support being fixed at least with respect to an axial direction relative to the container;

a grasping element movably connected to the support by a resiliently deformable connecting element in a manner such that, in response to a force exerted on the applicator element when the device is being held by the grasping element, the support is movable relative to the grasping element, and wherein the support is arranged to revert to its initial position when the exertion of force ceases, wherein said grasping element extends along at least a portion of a length of the container in a direction of the lengthwise axis, and wherein the grasping element extends about at least a portion of a circumference of the container, and further wherein the grasping element includes a first grasping portion arranged such that a user can grasp the device at the first grasping portion and apply the product with the support movable relative to the first grasping portion, and wherein the grasping element is movable relative to the container; and wherein the container further includes a second grasping portion, arranged for a user to grasp the device at the second grasping portion and apply the product with the support fixed relative to the second grasping portion, wherein the second grasping portion is a radially outer surface of the device at a position of the second grasping portion, and wherein with respect to the direction of the lengthwise axis the second grasping portion extends along a product containing portion of the container.

2. A device according to claim 1, wherein the connecting element includes a wall which extends over less than half the circumference of the support.

3. A device according to claim 1, wherein the connecting element includes a spring.

4. A device according to claim 1, wherein the connecting element includes at least one pair of resiliently deformable material bridges.

5. A device according to claim 1, wherein the connecting element includes a wall made of a resiliently deformable material.

6. A device according to claim 5, wherein the resiliently deformable material is selected from the group consisting of: very low density polyethylene, elastomers of propylene/ethylene copolymers, polyester block amides, polyvinyls, ethylene propylene diene terpolymers (EPDM), sequenced styrene-butadiene polymers (SBS), sequenced styrene-ethylene-butadiene polymers (SEBS-SIS), thermoplastic polyurethanes, mixtures of polypropylene with one of the elastomers selected from sequenced styrene-ethylene-butadiene polymers (SEBS-SIS), ethylene propylene diene terpolymers (EPDM), and sequenced styrene-butadiene polymers (SBS).

7. A device according to claim 1, wherein the grasping element is disposed at a sufficient distance from the container to allow relative movement of the grasping element in relation to the container.

8. A device according to claim 1, wherein the seating is traversed by the product emerging from the container.

9. A device according to claim 1, wherein the applicator element is non-rotatable in the seating.

10. A device according to claim 1, wherein the applicator element is rotatably movable in the seating.

11. A device according to claim 10, wherein the applicator element is rotatably movable about a point O in the seating.

12. A device according to claim 10, wherein the applicator element is rotatably movable about a geometric axis Y in the seating.

13. A device according to claim 12, wherein the axis of rotation Y is perpendicular to the lengthwise axis X of the container.

14. A device according to claim 1, wherein the applicator element is substantially spherical in shape.

15. A device according to claim 14, wherein the support includes a part shaped as a portion of a sphere which conforms to the shape of the applicator element.

16. A device according to claim 1, wherein the applicator element is substantially non-deformable during use.

17. A device according to claim 1, wherein the applicator element is made of a porous material.

18. A device according to claim 1, wherein when a force is not exerted a gap is present between the grasping element and said portion of the circumference of the container.

19. A device according to claim 1, wherein said grasping element is connected to a portion of a periphery of said support by said resiliently deformable connecting element.

20. A device according to claim 19, wherein the grasping element extends about the entire circumference of said container.

21. A device according to claim 20, wherein the grasping element has an axial length smaller than that of said container.

22. A device according to claim 1, wherein the grasping element is connected to the support by a plurality of resiliently deformable connecting elements.

23. A device for packaging and applying a product including:

a container holding the product;

an applicator element designed to come into contact with a surface to be treated in order to apply the product, wherein the applicator element is in fluid communication with the container;

a support defining a seating for the applicator element, the support being fixed at least with respect to an axial direction relative to the container;

a grasping element which is movably mounted on the device such that, in response to a force exerted on the applicator element when the device is being held by the grasping element, the support is movable relative to the grasping element, and wherein the support reverts to its initial position when the exertion of force ceases, wherein said grasping element extends along at least a portion of a length of the container in a direction of the lengthwise axis, and wherein the grasping element extends about at least a portion of a circumference of the container, and further wherein the grasping element includes a first grasping portion arranged such that a user can grasp the device at the first grasping portion and apply the product with the support movable relative to the first grasping portion; and wherein the grasping element includes a first end which is connected to the support by a resiliently deformable connecting element, and wherein the grasping element includes a second end at an end of the grasping element opposite the first end, and wherein the second end of the grasping element is a free end which is not connected to a deformable connecting element.

24. A device according to claim 23, wherein the container includes a second grasping portion arranged for a user to grasp the device at the second grasping portion and apply the product with the support fixed relative to the second grasping portion, wherein the second grasping portion is a radially outermost surface of the device at the second grasping portion, and wherein said second grasping portion is an outer surface of a product containing portion of the container and surrounds a product containing portion of the container.

25. A device according to claim 24, wherein the grasping element is tiltably mounted such that it tilts relative to the container when a user applies a product while grasping the first grasping portion.

26. A device according to claim 23, wherein said free end is spaced from an outer periphery of said container when the resiliently deformable connecting element is in an undeformed state.

27. A device according to claim 23, wherein the grasping portion is movable between a first position in which the resiliently deformable connecting element is in an undeformed state and a second position in which the resiliently deformable connecting element is deformed, and wherein at least part of the grasping element surrounds at least part of the container in both said first position and said second position.

28. A device according to claim 23, wherein said grasping element is movable relative to said container.

29. A device according to claim 28, wherein the grasping element extends about the entire circumference of said container.

30. A device according to claim 29, wherein the grasping element has an axial length smaller than that of said container.

31. A device according to claim 28, wherein when a force is not exerted a gap is present between the grasping element and said portion of the circumference of the container.

32. A device according to claim 23, wherein said grasping element is connected to a portion of a periphery of said support by the resiliently deformable connecting element.

33. A device according to claim 23, wherein the grasping element is connected to the support by a plurality of resiliently deformable connecting elements.

34. A device according to claim 1, wherein the grasping element includes a first end which is connected to the support by the resiliently deformable connecting element, and wherein the grasping element includes a second end at an end of the grasping element opposite the first end, and wherein the second end of the grasping element is a free end which is not connected to a deformable connecting element.

35. A device according to claim 34, wherein said free end is radially spaced from an outer periphery of said container when the resiliently deformable connecting element is in an undeformed state.

36. A device according to claim 1, wherein the grasping element is tiltably mounted such that it tilts relative to the container when a user applies a product while grasping the first grasping portion.

37. A device according to claim 1, wherein a portion of the container which contains the product protrudes axially beyond the grasping element.

38. A device according to claim 37, wherein the container includes an inwardly extending shoulder spaced from an end of the container so as to form a recess within which said grasping element is received.

39. A device according to claim 1, wherein the deformable connecting element is formed of a same material as the grasping element.

40. A device according to claim 1, wherein the second grasping portion extends at least partially around a product containing portion of the container.

41. A device according to claim 40, wherein with respect to the direction of the lengthwise axis of the container, the first grasping portion is positioned between the second grasping portion and an end of the applicator element.

42. A device according to claim 40, wherein the second grasping portion is immediately adjacent to the first grasping portion.

43. A device according to claim 1, wherein the second grasping portion is immediately adjacent to the first grasping portion.

44. A device for packaging and applying a product including:

a container holding the product;

an applicator element designed to come into contact with a surface to be treated in order to apply the product, wherein the applicator element is in fluid communication with the container;

a support defining a seating for the applicator element, the support being fixed at least with respect to an axial direction relative to the container;

a grasping element which is movably mounted on the device such that, in response to a force exerted on the applicator element when the device is being held by the grasping element, the support is movable relative to the grasping element, and wherein the support reverts to its initial position when the exertion of force ceases, wherein said grasping element extends along at least a portion of a length of the container and/or of the support in a direction of the lengthwise axis, and wherein the grasping element extends about at least a portion of a circumference of the container and/or of the support, and further wherein the grasping element includes a first grasping portion arranged such that a user can grasp the device at the first grasping portion and apply the product with the support movable relative to the first grasping portion;

wherein the grasping element includes a first end which is connected to the support by a resiliently deformable connecting element, and wherein the grasping element includes a second end at an end of the grasping element opposite the first end, and wherein the second end of the grasping element is a free end which is not connected to a deformable connecting element;

wherein the container includes a second grasping portion arranged for a user to grasp the device at the second grasping portion and apply the product with the support fixed relative to the second grasping portion, wherein the second grasping portion is a radially outermost surface of the device at the second grasping portion, and wherein said second grasping portion is an outer surface of a product containing portion of the container and surrounds a product containing portion of the container;

wherein the grasping element is tiltably mounted such that it tilts relative to the container when a user applies a product while grasping the first grasping portion; and wherein the container axially protrudes beyond the grasping element, and wherein the container includes an inwardly extending shoulder spaced from an end of the container so as to form a recess within which said grasping element is received, and wherein said second grasping portion is between said end of said container and said inwardly extending shoulder.

45. A device according to claim 1, wherein the grasping portion is movable between a first position in which the resiliently deformable connecting element is in an undeformed state and a second position in which the resiliently deformable connecting element is deformed, and wherein at least part of the grasping element surrounds at least part of the container in both said first position and said second position.

46. A device for packaging and applying a product including:

a container holding the product;

an applicator element designed to come into contact with a surface to be treated in order to apply the product, wherein the applicator element is in fluid communication with the container;

a support defining a seating for the applicator element, the support being fixed at least with respect to an axial direction relative to the container;

a grasping element which is movably mounted on the device such that, in response to a force exerted on the applicator element when the device is being held by the grasping element, the support is movable relative to the grasping element, and wherein the support reverts to its initial position when the exertion of force ceases, wherein said grasping element extends along at least a portion of a length of the container and/or of the support in a direction of the lengthwise axis, and wherein the grasping element extends about at least a portion of a circumference of the container and/or of the support, and further wherein the grasping element includes a first grasping portion arranged such that a user can grasp the device at the first grasping portion and apply the product with the support movable relative to the first grasping portion;

wherein the grasping element includes a first end which is connected to the support by a resiliently deformable connecting element, and wherein the grasping element includes a second end at an end of the grasping element opposite the first end, and wherein the second end of the grasping element is a free end which is not connected to a deformable connecting element; and wherein the grasping element is movable between a first position in which the resiliently deformable connecting element is undeformed, and a second position in which the resiliently deformable connecting element is deformed, and wherein in both said first and second positions said grasping element at least partially surrounds the container and/or the support, wherein at least part of the free end is closer to the container in the second position than in the first position, and wherein the grasping element is tilted in said second position relative to the first position.

* * * * *